US005658135A

United States Patent [19]

Sodergard

[11] Patent Number: 5,658,135

[45] Date of Patent: Aug. 19, 1997

[54] WASTE WATER PUMP STATION

[75] Inventor: Bengt Sodergard, Vasby, Sweden

[73] Assignee: ITT Flygt AB, Solna, Sweden

[21] Appl. No.: 715,285

[22] Filed: Sep. 16, 1996 SE

[22] Filed:

[51] Int. Cl.[6] ..... F04B 17/00

[52] U.S. Cl. ..... 417/360; 222/385

[58] Field of Search ..... 222/385, 377, 222/255; 285/24, 30; 417/360

[56] References Cited

U.S. PATENT DOCUMENTS

| | | | |
|---|---|---|---|
| 3,743,447 | 7/1973 | Lynch | 417/360 |
| 3,880,553 | 4/1975 | Wolford et al. | 417/360 |
| 3,885,714 | 5/1975 | Sjostrand | 417/360 |
| 3,938,545 | 2/1976 | Nagy et al. | 417/360 |
| 4,060,345 | 11/1977 | Blum | 417/360 |
| 4,308,000 | 12/1981 | Oakes | 417/360 |
| 4,324,531 | 4/1982 | Sarvanne | 417/360 |
| 4,392,790 | 7/1983 | Shibata et al. | 417/360 |
| 4,661,047 | 4/1987 | Weis | 417/360 |
| 4,886,426 | 12/1989 | Surinak | 417/360 |
| 4,948,342 | 8/1990 | Landquist | 417/279 |
| 5,044,526 | 9/1991 | Sasaki et al. | 417/360 |
| 5,211,547 | 5/1993 | Gaston et al. | 417/360 |
| 5,435,664 | 7/1995 | Pettersson | 417/360 |

*Primary Examiner*—Timothy Thorpe
*Assistant Examiner*—Peter G. Korytnyk
*Attorney, Agent, or Firm*—Menotti J. Lombardi

[57] ABSTRACT

A waste water pump station is provided for two submersible pump units which are attached to connection units on the station wall or on a shelf of the wall. The two connection units are attached in a reversed manner with respect to one another making it possible to mount them very close to the wall.

5 Claims, 3 Drawing Sheets

WASTE WATER PUMP STATION

BACKGROUND OF THE INVENTION

The invention concerns a pump station for waste water, said station containing one or several submersible pumps.

A pump station of this type is provided with one or several inlets for sewage water and normally one outlet pipe which is connected to the outlets of the pump or pumps. An example is shown in SE 366 013.

The submersible pump unit is normally arranged to be lowered along so called guides so located, that the outlet of the pump comes to alignment with the rigidly attached outlet pipe when the pump is lowered to its operating position. The connection between the pump outlet and the outlet pipe must be water tight, without the need for bolts or the like. For this purpose a so-called connection unit is fixed on the bottom of the pump station, which unit is provided with a pipe part, attached to the outlet pipe and with a flange to which a corresponding flange in the pump outlet can come into contact. The lower ends of the guides are also normally attached to said connection unit.

The sewage water normally contains a lot of solid bodies such as sludge, which easily collect on the bottom of the pump station. Other bodies such as rugs and fibres are easily wound up on the pump unit and its connection parts. Such sludge banks and rags check the circulation and may cause clogging of the pump inlet.

It is known practice to solve the problem with sludge banks by help of mixing devices which operate intermittently. An example is shown in SE 8900597-9 (U.S. Pat. No. 4,948,342). Other solutions are to install special machines which keep the water in motion.

Another solution to keep the bottom free of sludge is to design it very steep and locate the pump inlet at the lowest point. Examples are shown in U.S. Pat. No. 4661 047 and SE 9300 444-8 (U.S. Pat. No. 5,435,664. However, the problems with elongated objects that stick to the guides, the connection unit etc still remain.

SUMMARY OF THE INVENTION

According to the invention a reduction of the above mentioned problems is obtained by help of the device stated in the claims.

BRIEF DESCRIPTION OF THE DRAWINGS

The invention is described more closely below with reference to the enclosed drawings.

DESCRIPTION OF THE PREFERRED EMBODIMENTS

Figure 1:
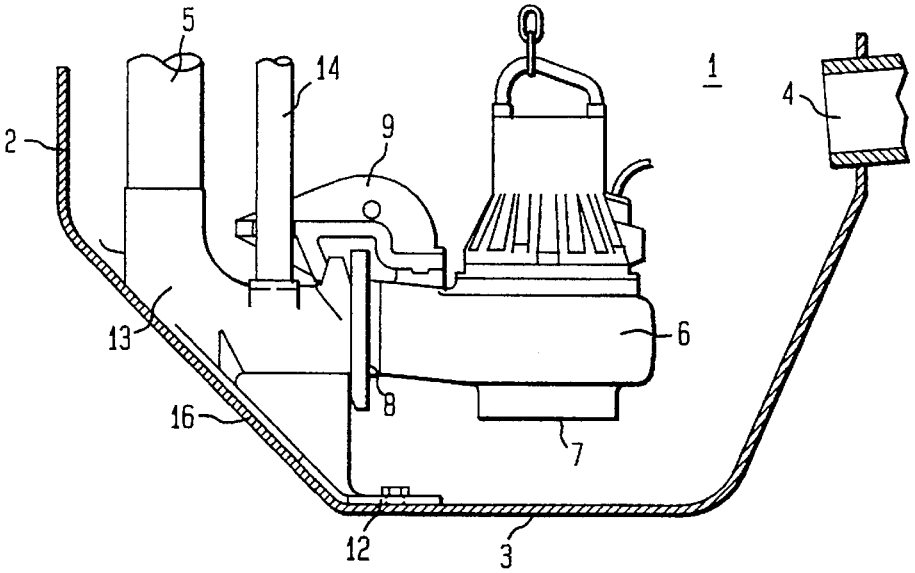
FIG. 1 shows a cut through the lower part of a pump station according to the invention.

In the drawings 1 stands for a pump station having a wall 2 and bottom 3. 4 and 5 stand for inlet and outlet pipes respective for sewage water and 6 two pump units with inlet 7, outlet 8 and sliding means 9. 10 stands for a connection unit with attaching means 11 and 12 respective, 13 a pipe part attached to the outlet 5 and 14 guides. 15 stands for a shelf integrated in the wall 2 and 16 a sloping plane forming a part of the bottom of the pump station.

As previously mentioned it is very important to design the pump station in such a way that collections of pollutions are minimized. This is obtained by minimizing the number of protruding parts within the pump station. In addition it is an advantage to make the volume as small as possible in order to minimize the amount of water that remains in the tank. The bigger amount the bigger risk for sludge banks being established. A smaller volume also means that the pumps have to operate at shorter intervals and thus the duration time in the tank shortens. This is of course also an advantage as to the risks for clogging.

In order to reduce the amount of protruding parts within the tank the invention provides for two reversed connection units 10 arranged mainly diametrically opposed in the circular tank quite close to the wall 2 within an area where the latter steeps like a funnel towards the bottom 3 of the tank.

The attachment of the connection unit 10 is made to the wall 2 or a sloping shelf 15 which is an integrated part of the wall having a rounded transition. This means that a very smooth transition is obtained between the wall and the connection unit thus diminishing the possibilities for collection of sludge. The sloping shelf 15 means that pollutions slide downwards to the bottom where the pumps have their inlets.

In order to obtain a sufficient stability the connection unit 10 is also attached to the horizontal bottom 3. The part that connects the two attachment parts in the wall and the bottom respectively is so designed, that it makes contact with the wall or the vertical part of the shelf 15 thus adding to the minimization of protruding parts.

As previously mentioned the two connection units 10 are reversed and opposedly located. The part 16 of the tank bottom that is located between the two connection units 10 is designed with a slope towards the center of the tank. This slope is also extended under the connection units in order to secure that pollutions slide towards the center where the pump inlets 7 are situated.

The location of the reversed connection units on the wall means that each pump unit will be located close to the wall. In turn this means that it often is possible to decrease the diameter of the tank as compared with the conventional connection means. The result is thus often a less expensive pump station which demands less space and has a smaller water volume which gives a quicker percolation.

Figure 2:
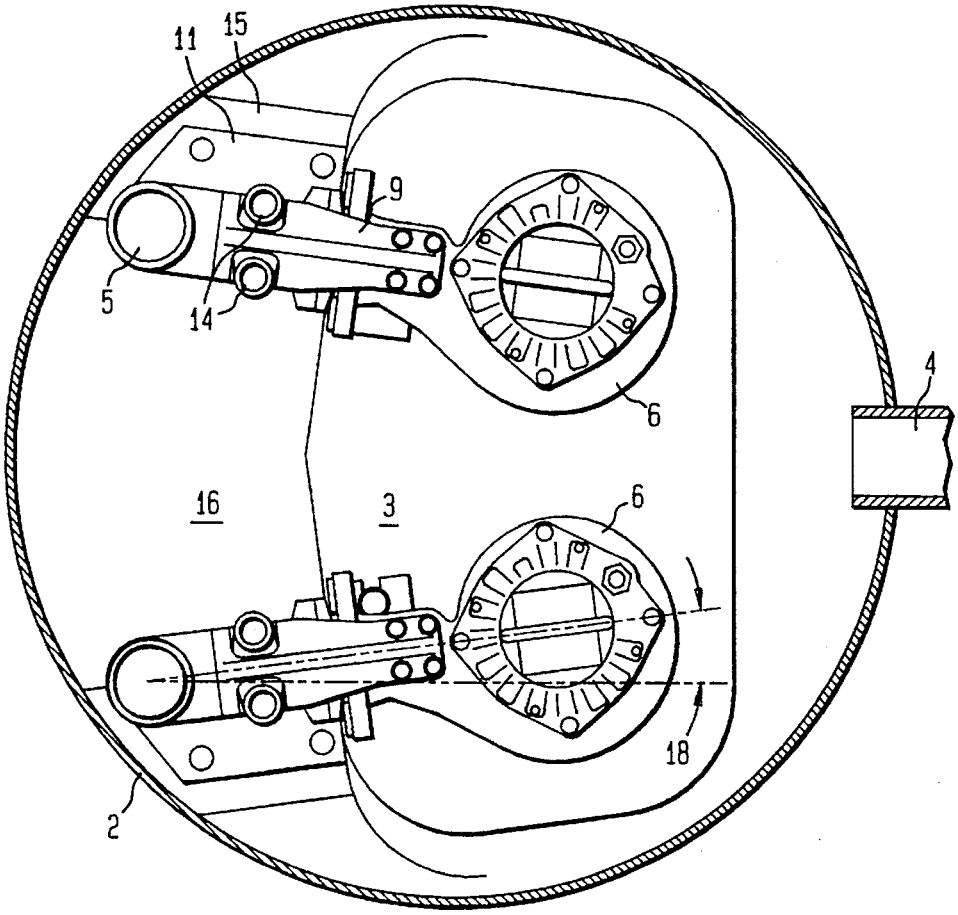
FIG. 2 shows a view of the pump station seen from above.
Figure 3:
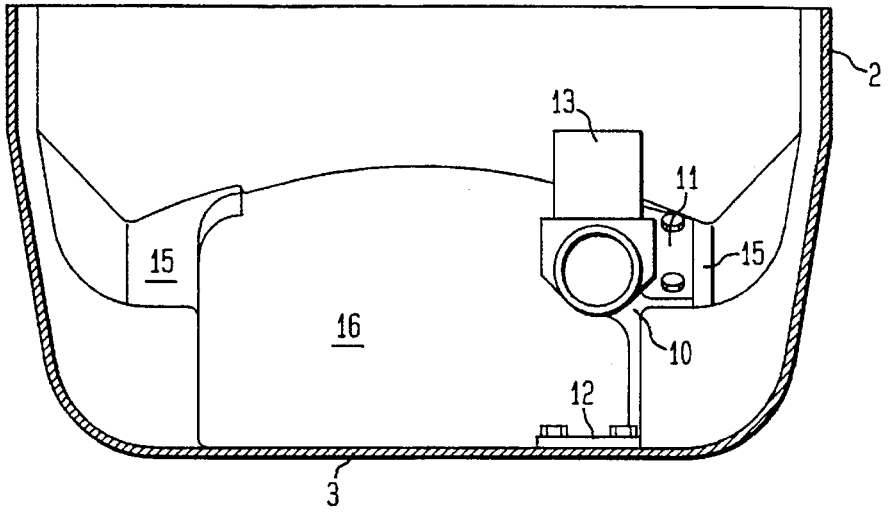
FIG. 3 shows a cut through the pump station turned 90° as compared with the cut shown in FIG. 1 (certain details eliminated).
Figure 4:
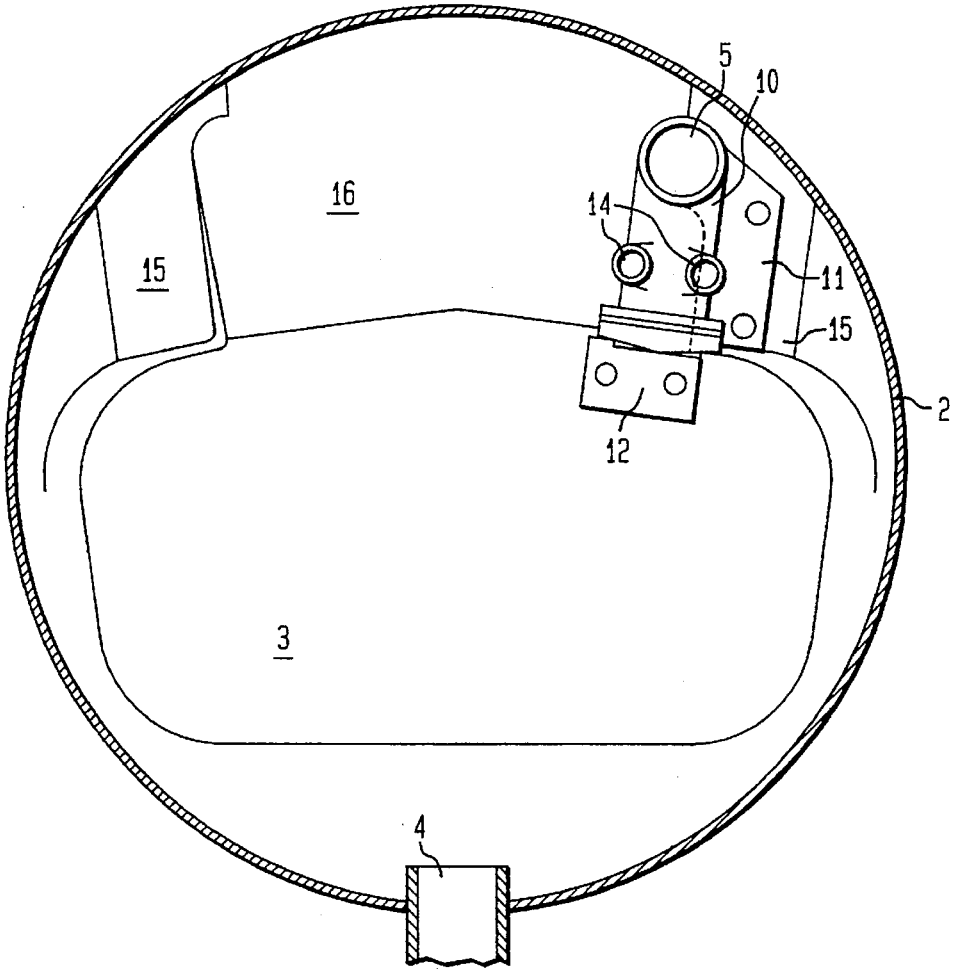
FIG. 4 shows a view of the pump station seen from above (certain details eliminated).
Figure 5:
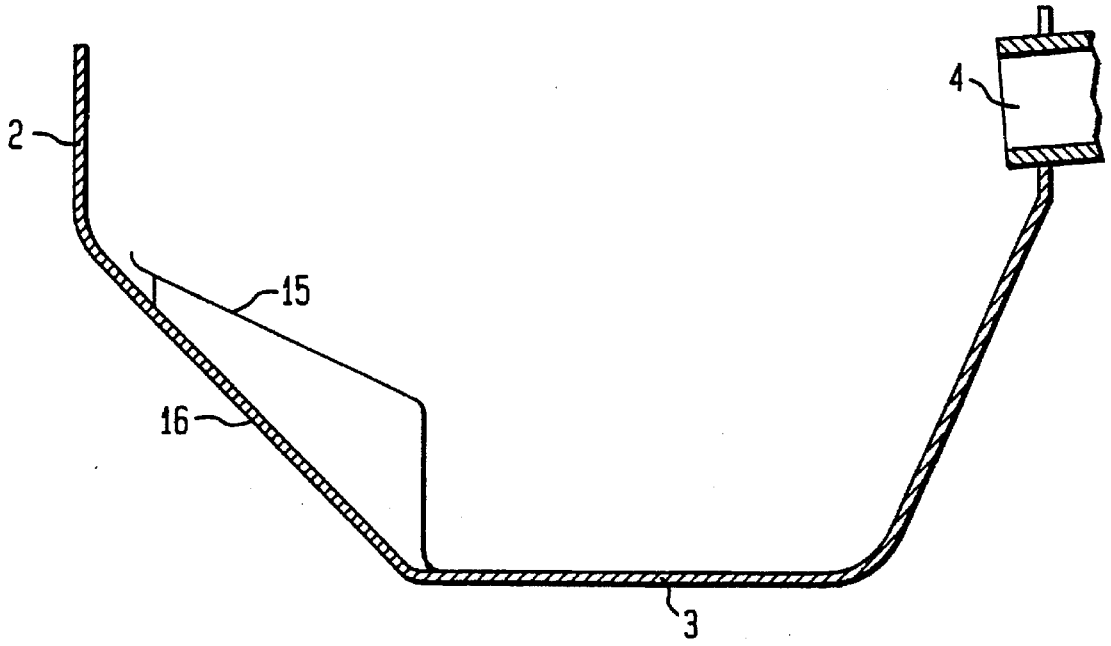
FIG. 5 shows a detail within the pump station.

In order to further minimize the diameter of the tank the connection units may be somewhat deflected in the direction of the center of the tank, see FIG. 2, the two pump units 6 then being located closer to the center. A deflection angle 18 of 5° to 10° is suitable.

I claim:

1. A waste water pump station for two submersible pump units (6) provided with easily releasable pressure connections (8) to rigidly mounted outlet pipes (5), characterized in that the attachment of each pump unit (6) within the pump station (1) is carried out via a connection unit (10) with an integrated outlet pipe connection (13) on the side wall (2) of the pump station by means of an attaching means (11); and that each connection unit (10) is also attached to a bottom (3) of the pump station by means of an attaching means (12), the connection part between the attaching means (11) and (12) being designed to contact the wall (2).

2. A waste water pump station for two submersible pump units (6) provided with easily releasable pressure connections (8) to rigidly mounted outlet pipes (5), characterized in that the attachment of each pump unit (6) within the pump station (1) is carried out via a connection unit (10) with an integrated outlet pipe connection (13) on the side wall (2) of the pump station by means of an attaching means (11); and that the connection units (10) form an angle of up to 10°relative to each other, wherein the pump units (6) mounted on said connection units are directed towards a center of the pump station.

3. A waste water pump station for two submersible pump units (6) provided with easily releasable pressure connections (8) to rigidly mounted outlet pipes (5), characterized in that the attachment of each pump unit (6) within the pump station (1) is carried out via a connection unit (10) with an integrated outlet pipe connection (13) on a sloping shelf (15) on the side wall of the pump station by means of an attaching means (11); and that each connection unit (10) is also attached to a bottom (3) of the pump station by means of attaching means (12), the connection part between the attaching means (11) and (12) being designed to contact the vertical part of the shelf (15).

4. A waste water pump station according to claim 3, characterized in that the connection units (10) form an angle of up to 10° relative to each other, wherein the pump units (6) mounted on said connection units are directed towards the center of a pump station.

5. A waste water pump station according to claim 4, characterized in that said angle is preferably 5°.

* * * * *